US008632019B2

(12) United States Patent
Lo

(10) Patent No.: US 8,632,019 B2
(45) Date of Patent: Jan. 21, 2014

(54) AUTOMATIC FLOW REGULATION SPRINKLER FOR GARDENING

(76) Inventor: Shun-Nan Lo, Taichung (TW)

( * ) Notice: Subject to any disclaimer, the term of this patent is extended or adjusted under 35 U.S.C. 154(b) by 571 days.

(21) Appl. No.: 12/923,104

(22) Filed: Sep. 2, 2010

(65) Prior Publication Data

US 2012/0056010 A1 Mar. 8, 2012

(51) Int. Cl.
*B05B 3/00* (2006.01)

(52) U.S. Cl.
USPC ..... 239/225.1; 239/587.5; 239/222.11; 239/242; 239/264; 239/538

(58) Field of Classification Search
USPC ..... 239/214, 222.11, 225.1, 231, 242, 264, 239/581.1, 582.1, 587.1, 587.5, 538, 236; 137/887
See application file for complete search history.

(56) References Cited

U.S. PATENT DOCUMENTS 1,938,838 A * 12/1933 Jacobson ..... 239/236
7,566,012 B2 * 7/2009 Wang et al. ..... 239/237

* cited by examiner

*Primary Examiner* — Jason Boeckmann
(74) *Attorney, Agent, or Firm* — Raymond Y. Chan; David and Raymond Patent Firm

(57) ABSTRACT

An automatic flow regulation sprinkler for gardening includes a base having a linking first water way and second water way on opposite sides thereof. Two outer ends of a transverse axle tube communicates the first water way and the second water way respectively. The transverse axle tube has at least one water outlet. A mobile tube has a front water way, water outlet, and an outer transverse water way communicating the front water way. The outer transverse water way pivoted to the transverse axle tube so as to rotate freely. The outer transverse water way has a regulating portion arranged around the transverse axle tube so as to block the water outlet of the transverse axle tube. Therefore, water flow can be regulated based on the angle of elevation of the mobile tube.

8 Claims, 13 Drawing Sheets

AUTOMATIC FLOW REGULATION SPRINKLER FOR GARDENING

BACKGROUND OF THE INVENTION

1. Fields of the Invention

The present invention relates to sprinkler, and particular to a sprinkler capable of automatically regulating the water flow based on range of the spout.

2. Descriptions of Related Art

In accordance of a published U.S. Pat. No. 5,769,322, a rotary sprinkler and base are disclosed. The range of spout can be adjusted by a diversion sheet of the invention. However, the invention still has following disadvantages.

1. The water flow of the nozzle cannot be adjusted so that the spout being blocked by a lowered diversion sheet will cause strong splash of water which might damage flowers and plants.

2. While the spring linking the diversion plate and the linking rod is inactive, the diversion sheet will no longer change a position to adjust the range of spout.

Another U.S. Pat. No. D297255 "Sprinkler head" disclosed that a sprinkler head arranged upon a sprinkler base, and the sprinkler base has a round disk. A round track with partially height adjustable function is arranged on the round disk. An end of the sprinkler head can run around the track so as to adjust the angle of elevation of the sprinkler head. However, the invention still can't control the water flow thereof.

SUMMARY OF THE INVENTION

Accordingly, the primary objective of the present invention is to provide a sprinkler with a function of automatic water flow regulation based on the spout range so as to provide longer range spout with higher water flow and shorter range spout with lower water flow.

DETAILED DESCRIPTION OF THE PREFERRED EMBODIMENT

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 11, a preferable embodiment of the present invention is illustrated. An automatic flow regulation sprinkler for gardening includes a base 10, transverse axle tube 20, and a mobile tube 30.

Figure 2:
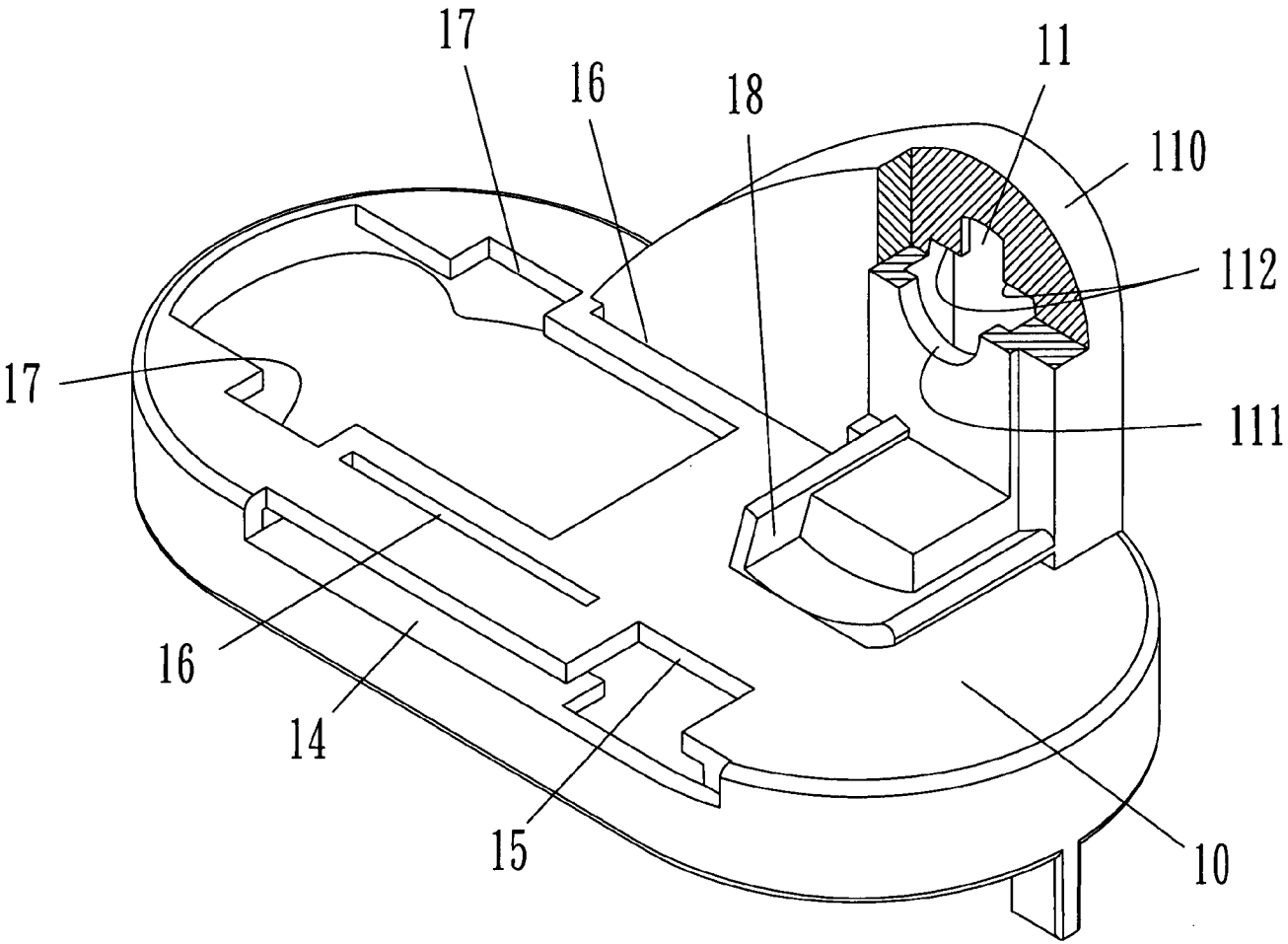
FIG. 2 is a schematic view showing a base of the preferable embodiment of the present invention.
Figure 3:
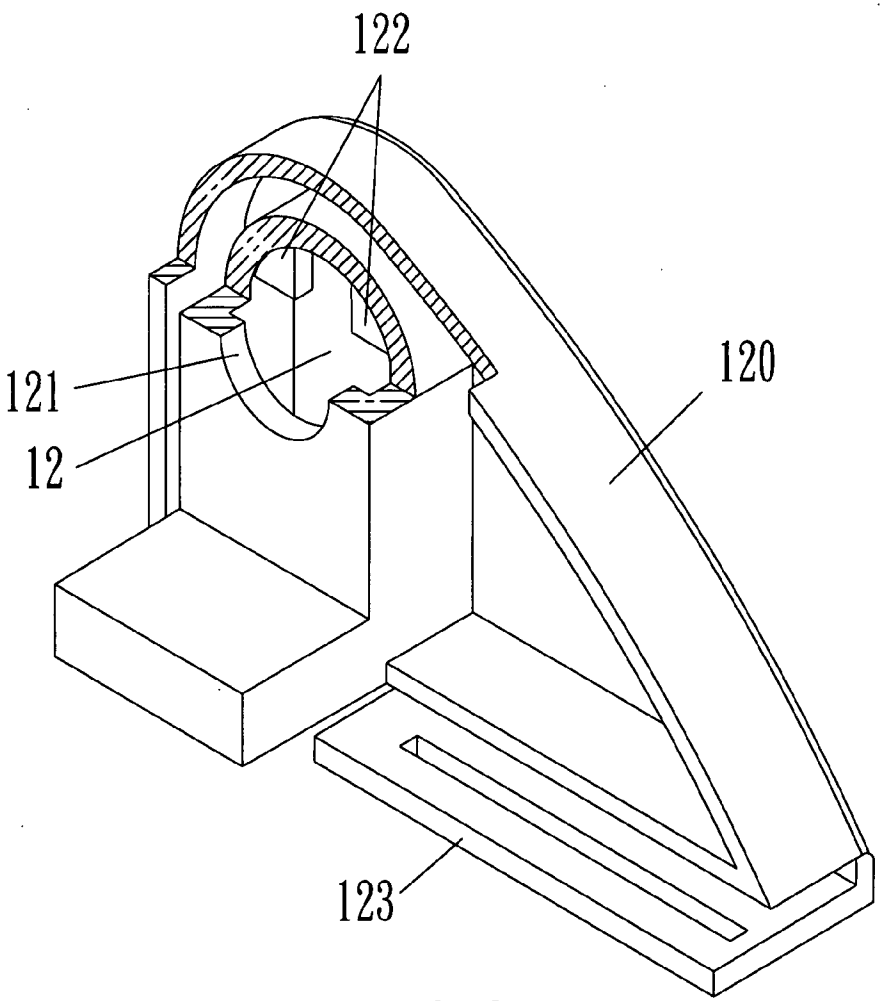
FIG. 3 is a schematic view showing a mobile rack of the preferable embodiment of the present invention.
Figure 4:
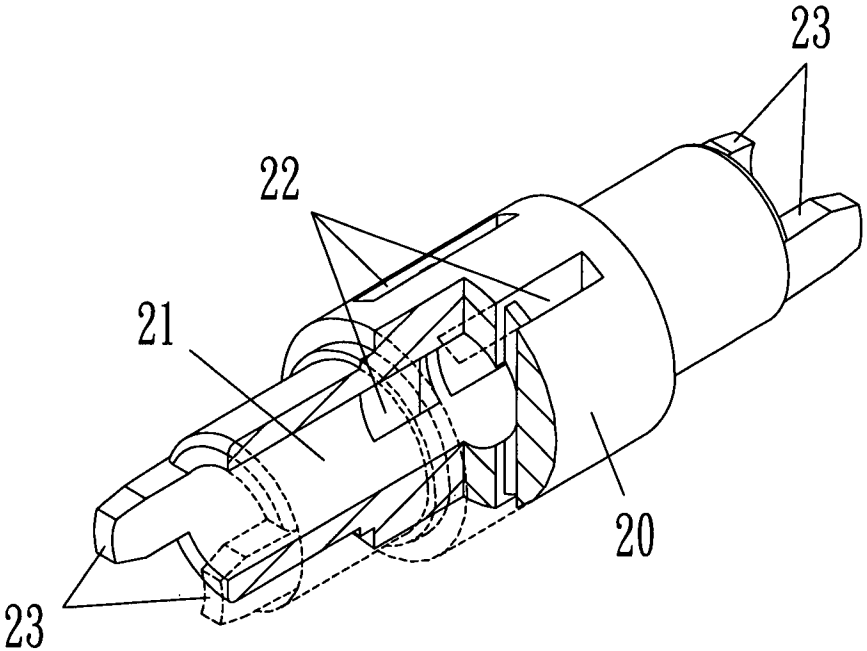
FIG. 4 is a schematic view showing a transverse axle tube of the preferable embodiment of the present invention.
Figure 12:
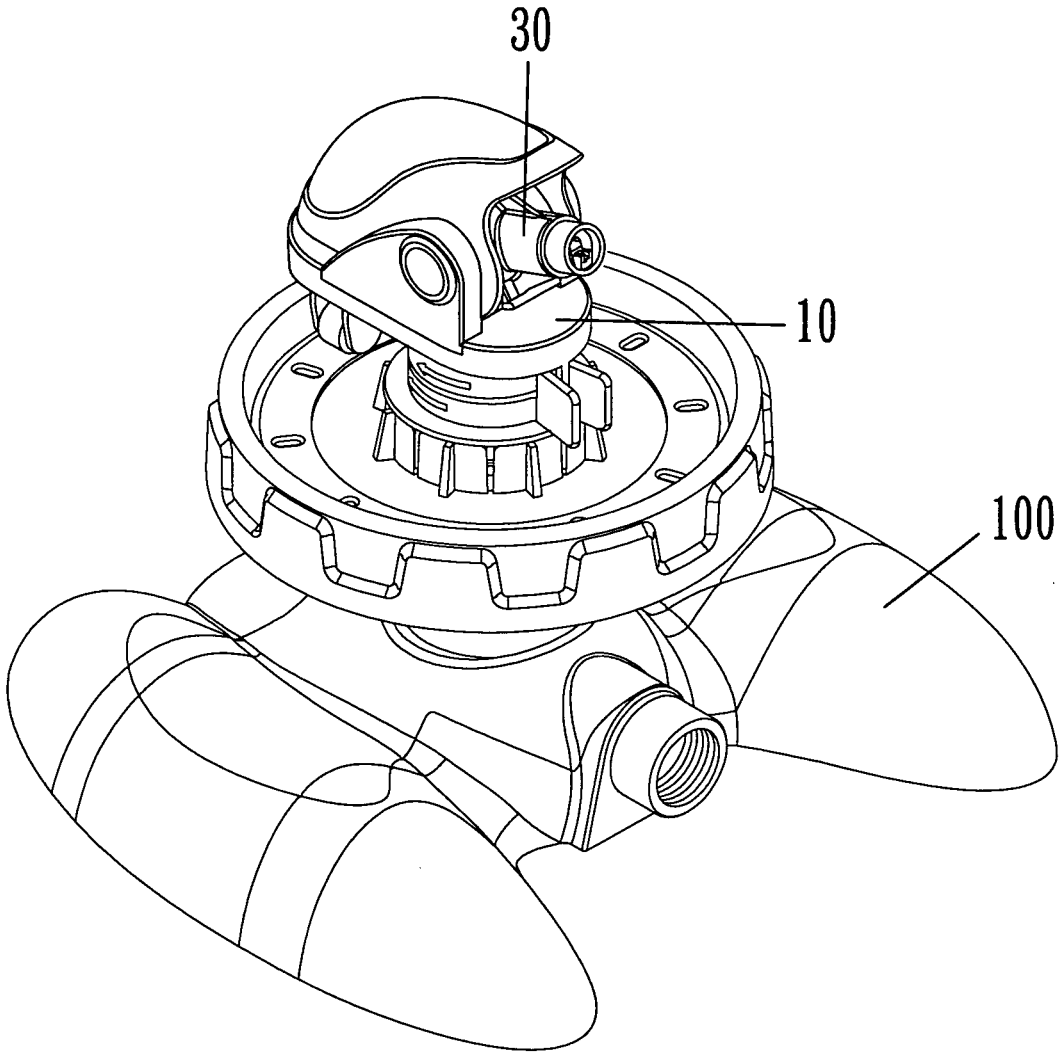
FIG. 12 is a schematic view showing a disassembly of the sprinkler seat and the present invention.
Figure 13:
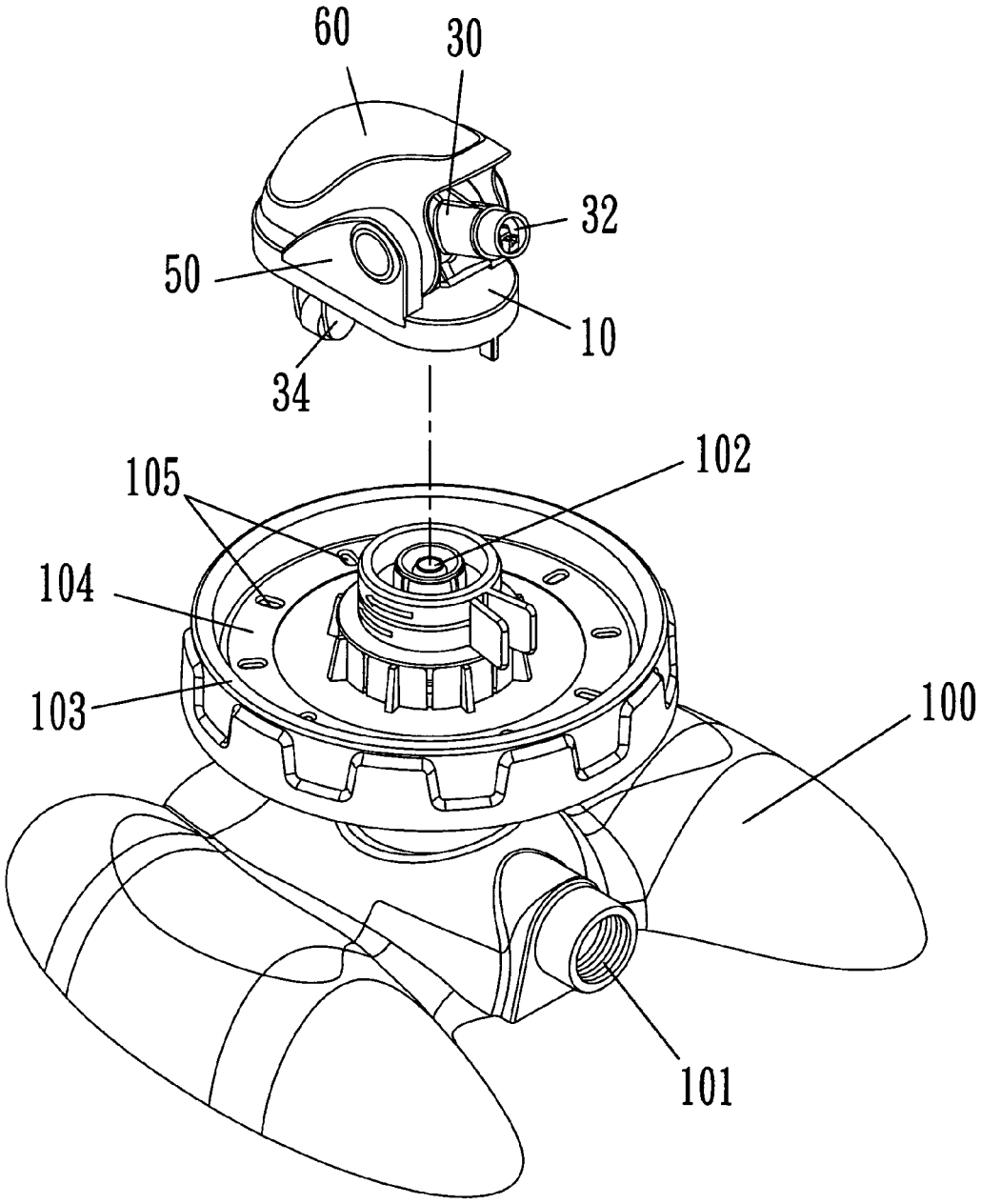
FIG. 13 is a schematic view showing an assembly of the sprinkler seat and the present invention.

The base 10 has a first water way 11 and second water way 12 on opposite sides thereof. A first water outlet 111 and a second water outlet 121 are formed to relative inner sides of the first water way 11 and second water way 12, and the first water outlet 111 is aligned to the second water outlet 121. A spacing portion 112 is formed beside the water outlet 111 of the first water way 11 as shown in FIG. 2. A spacing portion 122 is formed beside the water outlet 121 of the first water way 12 as shown in FIG. 3. The first water way 11 is formed inside a fixing rack 110, and the second water way 12 is formed inside a mobile rack 120. The fixing rack 110 perpendicularly extends from a lateral side of the base 10, and the mobile rack 120 perpendicularly extends from an opposite lateral side of the base 10. A linking pipe 13 is arranged to a bottom side of the base 10 to link the first water way 11 and the second water way 12. The linking pipe 13 can be linked to a water outlet 102 of a sprinkler seat 100 as shown in FIGS. 12 and 13. The connection between the linking pipe 13 and the first water way 11 and the second water way 12 can be achieved by high frequency pressing or other method with equivalent effect.

The transverse axle tube 20 has an axial inner transverse water way 21 inside thereof. At least one water outlet 22 is formed to the middle section of the transverse axle tube 20, the at least one water outlet 22 communicates the inner transverse water way 21. The two ends of the transverse axle tube 20 are connected to the first water outlet 111 and the second water outlet 121 respectively. The connection of the transverse axle tube 20 between the first water outlet 111 and the second water outlet 121 can be achieved by high frequency pressing or other known method. In the embodiment of the present invention, the water outlets 22 are formed symmetrically around the transverse section of the transverse axle tube 20. Symmetric protrusions 23 are formed to two ends of the transverse axle tube 20. The upper surfaces of the protrusions 23 can be attached and fixed to the spacing portions 112 and 122 of the first water way 11 and the second water way 12.

The mobile tube 30 has a front water way 31 inside the mobile tube 30. A water outlet 311 is formed to an end of the water way 31. A nozzle 32 capable of extending a range of the spout is formed to the water outlet 311. An outer transverse water way 33 is formed to another end of the front water way 31, and the outer transverse water way 33 communicates the front water way 31. In the embodiment, the outer transverse water way 33 is perpendicular to the front water way 31, and the outer transverse water way 33 can be pivoted to the transverse axle tube 20. The outer transverse water way 33 has a regulating portion 331 inside thereof. The regulating portion 331 covers the transverse axle tube 20 so as to block the at least one water outlet 22 for regulating the water flow. The regulating portion 331 is a sleeve, and an inner wall 3311 thereof covers the outer appearance of the transverse axle tube 20 with a gap between so that the regulating portion 331 can be freely rotated around the transverse axle tube 20. The sleeve has at least one open hole 3312, the at least one open hole 3312 matches to the at least one water outlet 22 of the transverse axle tube 20 so that the open hole 3312 can be aligned to the water outlet 22 or rotated to gradually block the water outlet 22. The outer transverse water way 33 has a pair of symmetric spacing slot 332 on the inner wall thereof, and the outer wall of the sleeve of the regulating portion 331 has corresponding protrusions 3313 so that the regulating portion 331 can be fixed to the outer transverse water way 33. The engaging between the spacing slots 332 and thd protrusions 3313 have a predetermined margin for allowing the regulating portion 331 to a proper position so as to smooth the swing of the mobile tube 30 pivoted to the transverse axle tube 20.

Moreover, another end of the mobile tube 30 opposite to the front water way 31 has a bent down extension portion 34. A receiving slot 341 is formed to an end of the extension portion 34, symmetric axles 342 are formed to opposite two sides inside the extension portion 34 for pivoting a wheel 35. A center of gravity of the mobile tube 30 is close to the extension portion 34 while the transverse axle hole 33 is regarded as a pivot so that the extension portion will keep hanging down.

Figure 9:
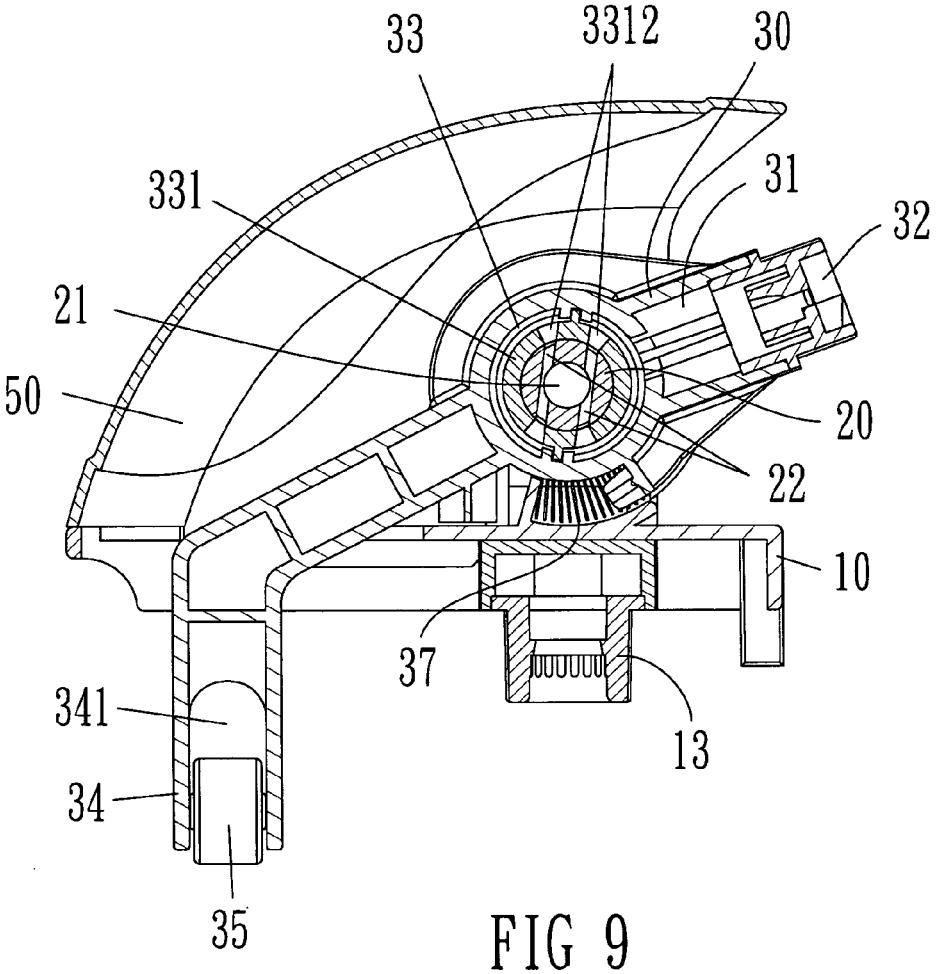
FIG. 9 is a cross-section view along a B-B line in the FIG. 8.
Figure 10:
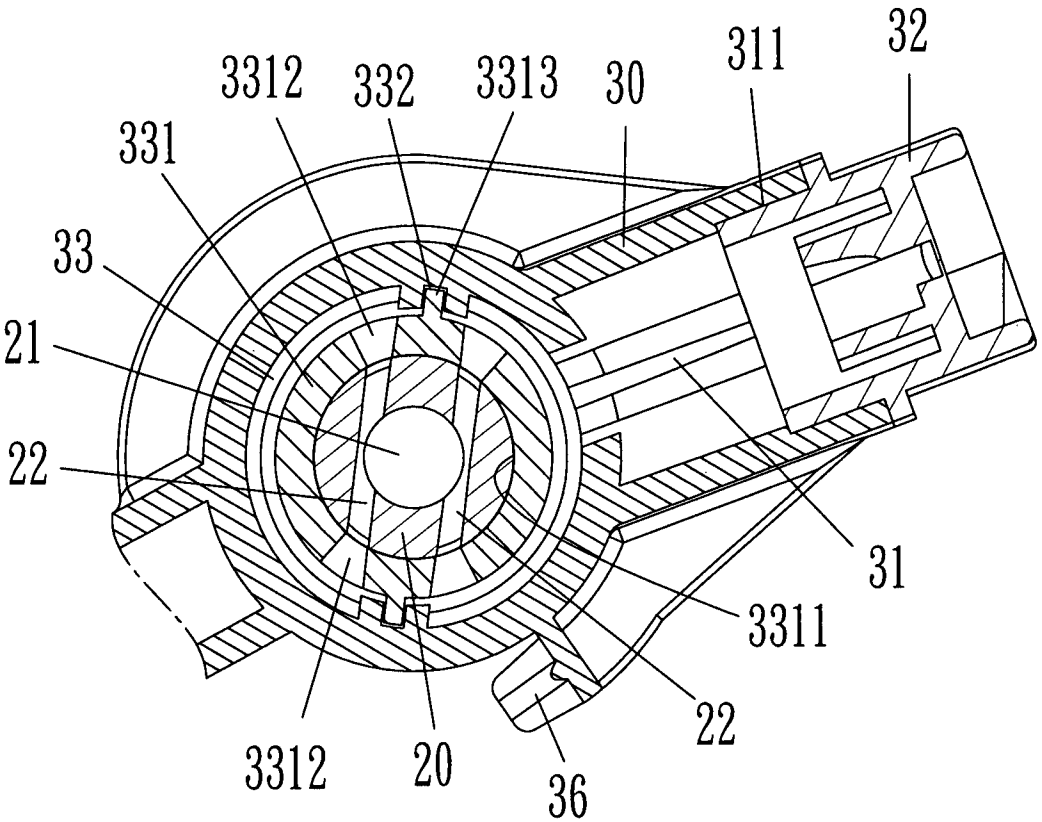
FIG. 10 is a partially enlarged view of the FIG. 9.

Referring to FIGS. 9 and 10, the open hole 3312 of the regulating portions 331 are aligned with the water outlets 22 naturally. In such position, the front water way 31 of the mobile tube 30 has the largest angle of elevation. Water come through the first and second water way 11, 12 from the base 10 will flow into the transverse water way 21 of the transverse axle tube 20 through the first and the second water outlet 111, 121. Through the aligned open holes 3312 and water outlets 22, water will flow into the outer transverse water way 33 and the mobile tube 30 so as to be sprinkled out of the water outlet 311 through the front water way 31 of the mobile tube 30. Water will be sprinkled to the farthest range because there is no obstacle against the water flow in such circumstance.

Figure 11:
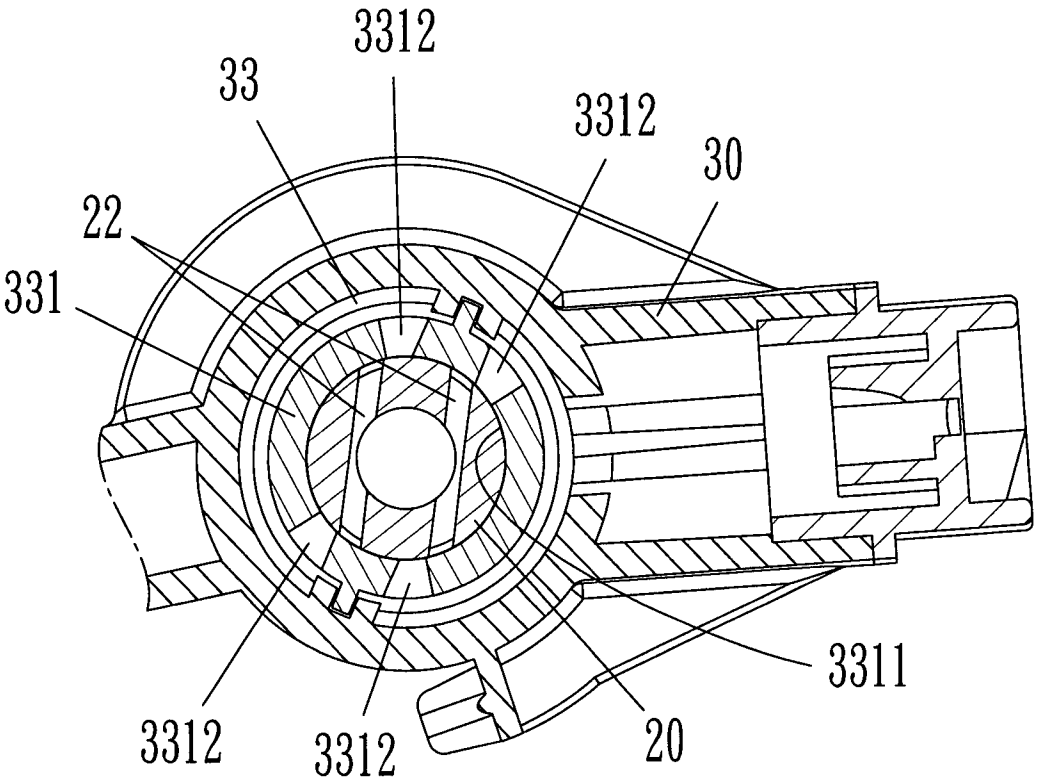
FIG. 11 is a schematic view showing a rotation operation in FIG. 9.

Referring to FIG. 11, while the mobile tube 30 pivoted to the transverse axle tube 20 swinging by the push of the extension portion 34, the angle of elevation of the mobile tube 30 is changed and the regulating portion 331 will be rotated so that the open holes 3312 are gradually away from the water outlets 22. Therefore, while the angle of elevation of the mobile tube 30 is gradually lowered, the spout ranged out of the water outlet 311 will be shortened, and the water flow will be gradually decreased in the same time. Through the assembly, the mobile tube 30 will adjust water flow automatically depending on the range of the spout.

Figure 5:
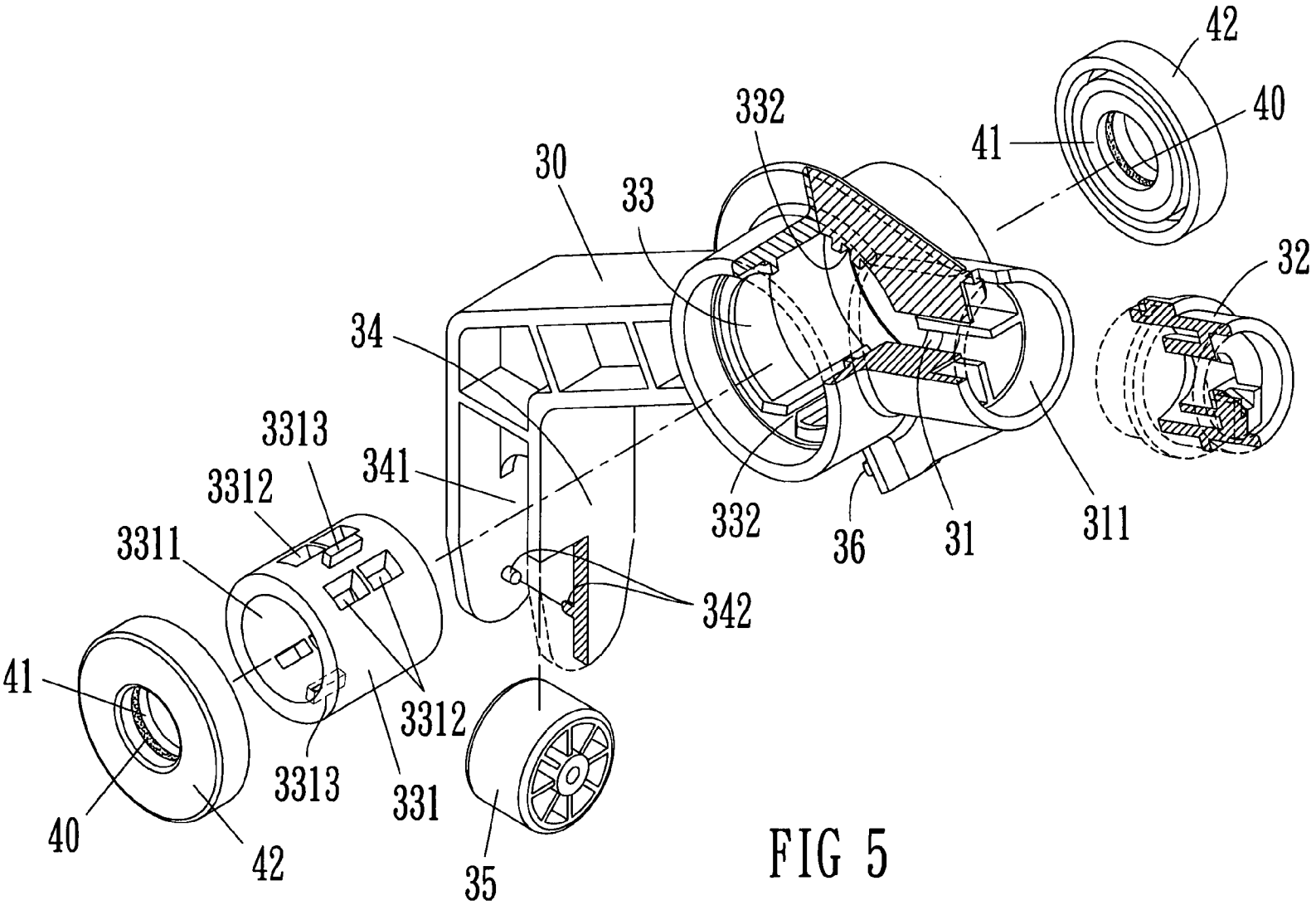
FIG. 5 is an exploded view showing a mobile tube of the preferable embodiment of the present invention.
Figure 6:
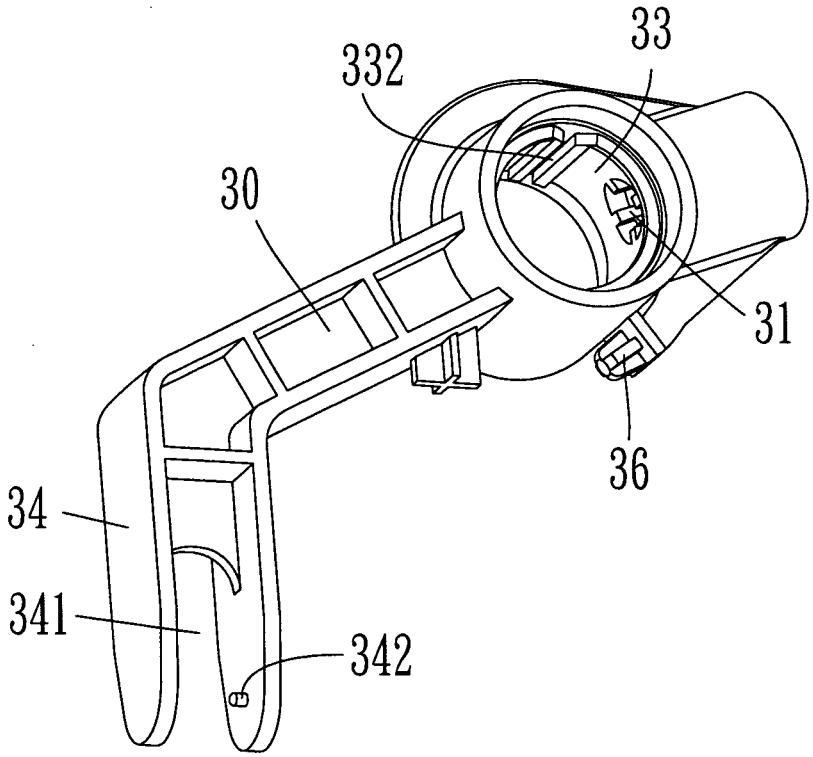
FIG. 6 is a schematic view showing the mobile tube of the preferable embodiment of the present invention.
Figure 7:
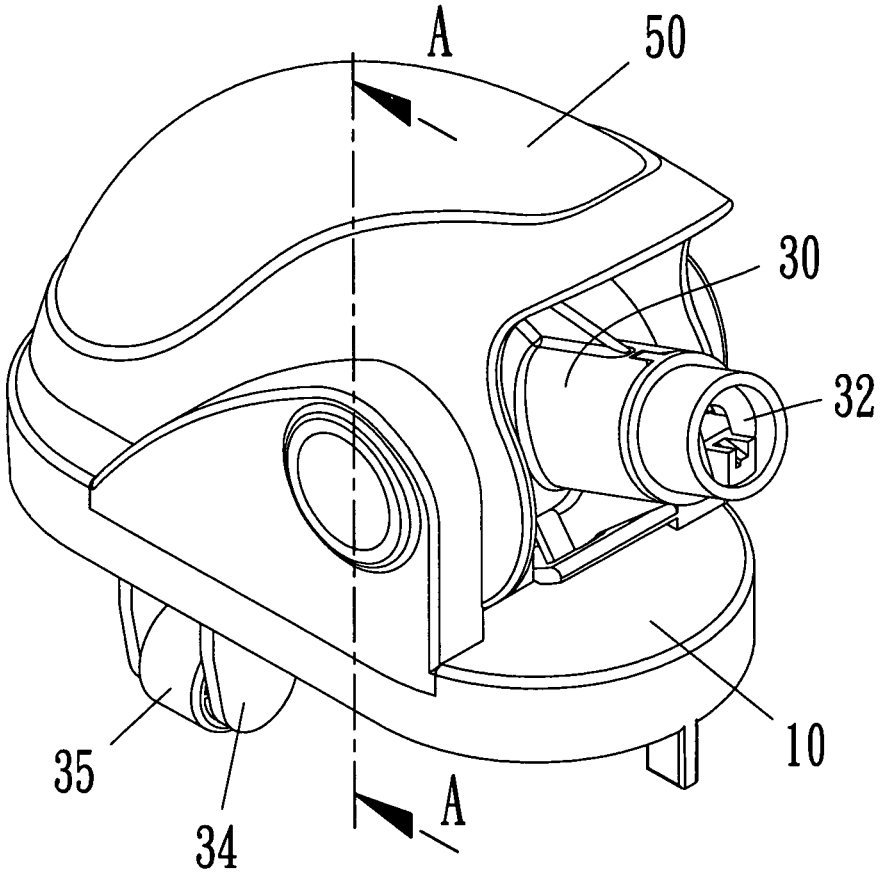
FIG. 7 is an assembly view showing the preferable embodiment of the present invention
Figure 8:
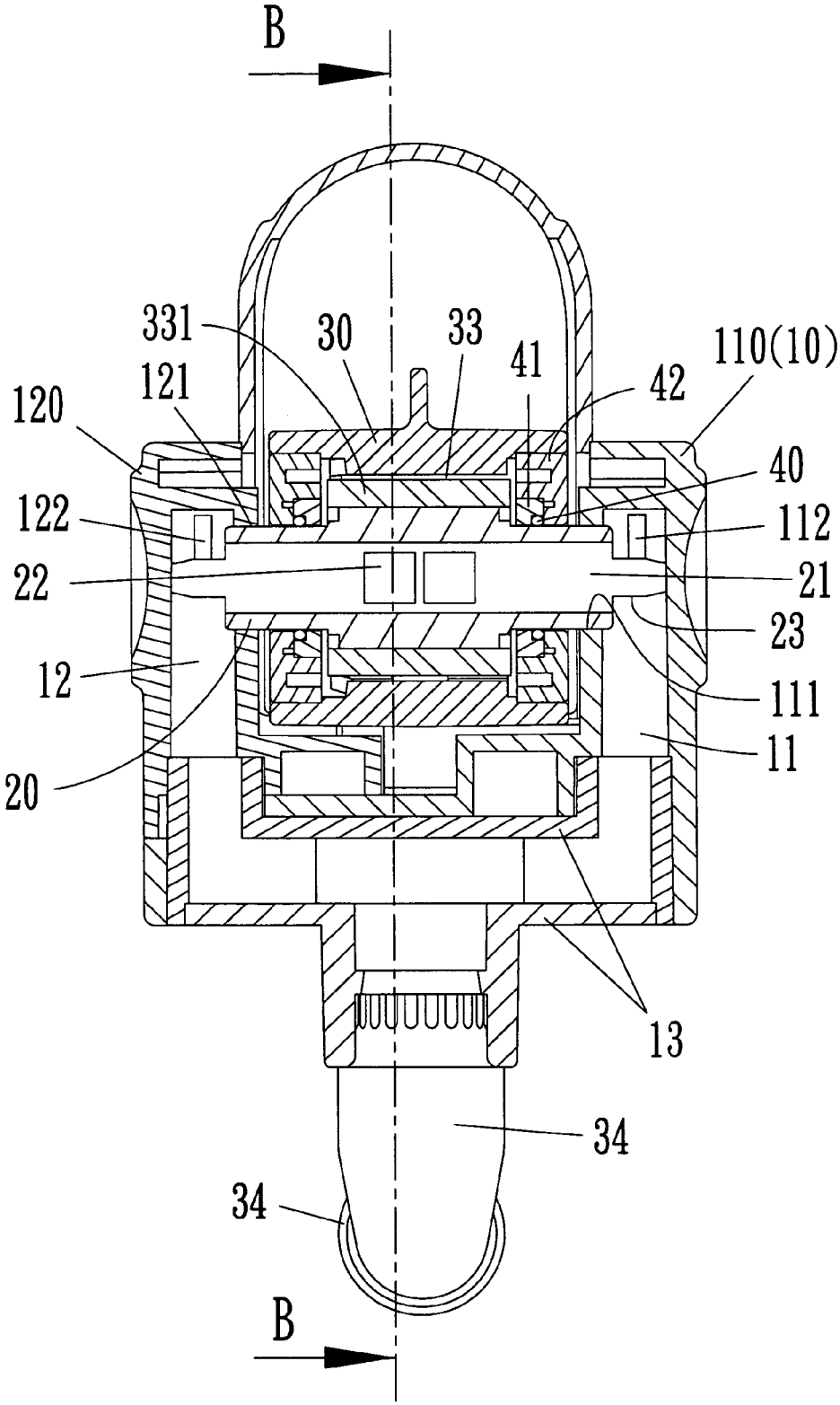
FIG. 8 is a cross-section view along an A-A line in the FIG. 7.

Besides, two water seals 40 are arranged between the transverse axle tube 20 and the outer transverse water way 33 as shown in FIGS. 5 and 8. The two water seals 40 are arranged to two relative outer sides of the water outlets 22 of the transverse axle tube 20. In the embodiment, the water seal 40 is located between an inner ring 41 and an outer ring 42, and the assembly is arranged to the transverse axle hole 33 of the mobile tube 30.

Moreover, a retaining slot 14 is formed to the lateral side of the base 10 relative to the fixing rack 110. A vertical link 15 is formed to an end of the retaining slot 14. A transverse plate 123 is formed to the mobile rack 120 on an outer side of the second water way 12. The transverse plate 123 can be buckled to the transverse slot 14 so that the second water way 12 can be linked to the linking pipe 13 within the vertical link 15.

Figure 1:
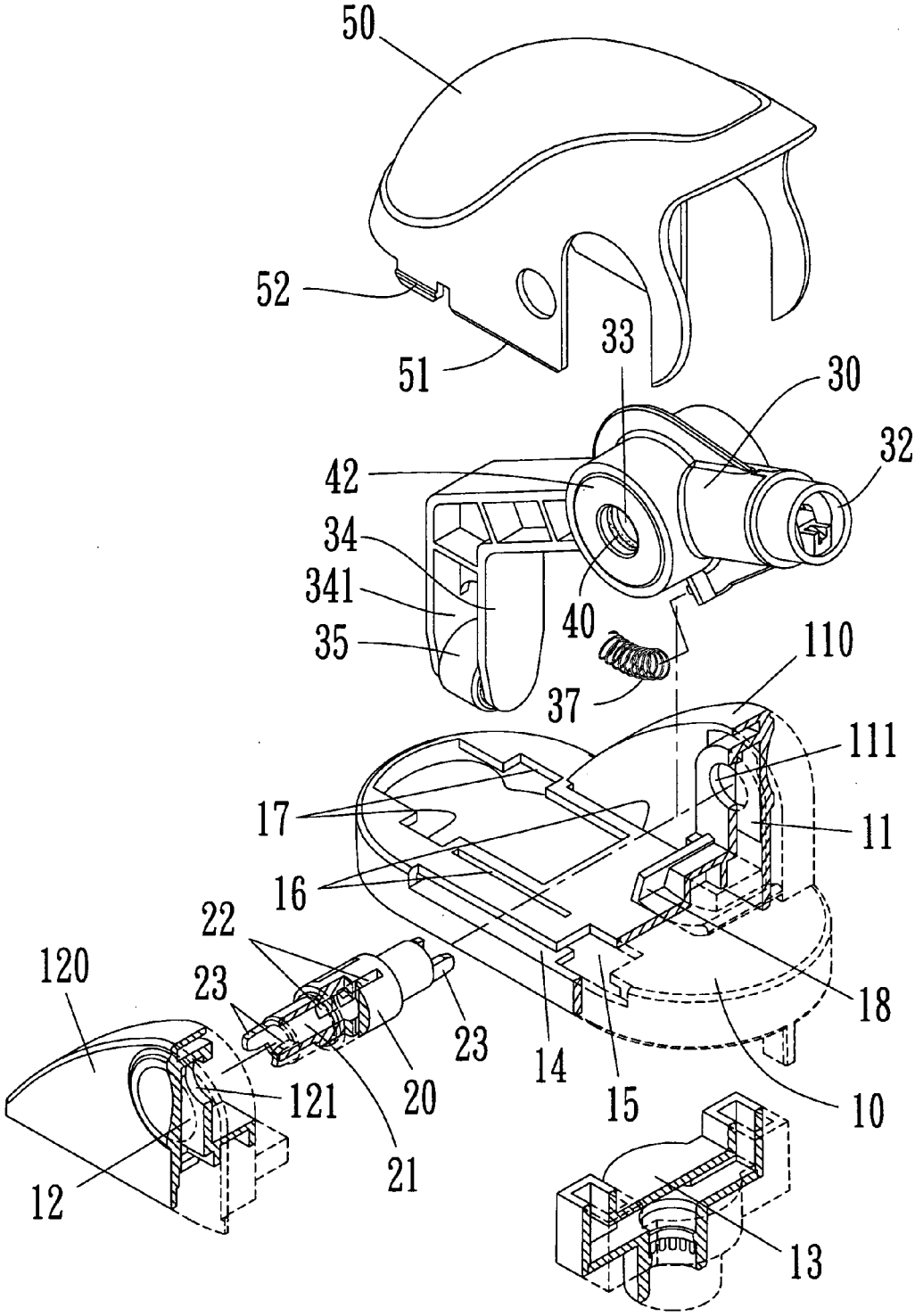
FIG. 1 is an exploded view showing a preferable embodiment of the present invention.

Referring to FIG. 1, a cover 50 capable of covering the mobile tube 30 and the extension portion 34 of the mobile tube 30 is arranged upon the base 10. Only the nozzle 311 of the mobile tube 30 reveal outside the cover 50. The cover 50 is approximately a quarter of a circle. Two symmetric front tenons 51 and two symmetric rear tenons 52 are formed to two bottom lateral edges of the cover 50. Two symmetric front retaining recesses 16 and two symmetric rear retaining recesses 17 are formed to predetermined locations of the base 10 for retaining the front and the rear tenons 51 and 52 respectively.

Referring to FIGS. 12 and 13, the sprinkler of the present invention is connected to a sprinkler seat 100 for lawn. The sprinkler seat 100 has a water inlet 101 on a lateral side. The water outlet 102 is arranged to a top of the sprinkler seat 100. An automatically spinning gear device driving by water flow is arranged below the water outlet 102 (not shown). A round disk 103 is arranged around the water outlet 102. A plurality of spacing hole (not shown) is formed to the round disk 103 with predetermined gap between. A plurality of adjusting foot 105 is formed below an elastic round track 104 formed around the water outlet 102. The plurality of the adjusting foot 105 can be inserted into the plurality of spacing hole for specific height adjustment.

Therefore, while the link pipe 13 of the vertical water way 11 is connected to the water outlet 102 of the sprinkler base 100, the nozzle will be rotated back and forth within a predetermined range by the driving of water flow. The wheel 35 fixed to the extension portion 34 of the mobile tube 30 will touch the round track 104 and swung up and down with the function of automatic water flow regulation based on the spout range.

Referring to FIGS. 1 and 9, a shield 18 is formed to the base 10 between the fixing rack 110 and the mobile rack 120. A short column 36 towards the extension portion 34 is formed to a bottom surface of the mobile tube 30 below the outer transverse water way 33. The short column 36 has a spring unit 37 pushing against the shield 18. While the mobile tube 30 is pushed by the extension portion 34, the spring unit 37 will be compressed between the short column 36 and the shied 18. While the extension portion 34 is moving down, the spring unit 37 will assist the mobile tube 30 to restore its natural status.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An automatic flow regulation sprinkler for gardening, comprising:

a base comprising a transverse axle tube, wherein said transverse axle tube has at least one water outlet; and a mobile tube comprising a front water way and an outer transverse water way linking to each other, wherein another end of said mobile tube opposite to said front water way comprises an extension portion, wherein said outer transverse water way is pivoted to said transverse axle tube, wherein said outer transverse water way comprises a regulation portion arranged around said transverse axle tube, wherein said regulation portion is a sleeve having at least one open hole, wherein when said open hole is aligned with said water outlet, the farthest range and the largest volume of the water flow is provided, wherein when said mobile tube swings by the push of said extension portion, said open hole is gradually away from said corresponding water outlet, the angle of elevation of said front water way of said mobile tube is gradually lowered, the spout ranged out of said water outlet is shortened, and water flow is gradually decreased, wherein a receiving slot is formed to an end of said extension portion, wherein symmetric axles are formed to opposite two sides inside said extension portion, wherein a wheel is pivoted between said symmetric axles in said receiving slot, wherein a center of gravity of said mobile tube is close to said extension for normally keeping hanging down said extension portion.

2. The automatic flow regulation sprinkler for gardening, as recited in claim 1, wherein said outer transverse water way has a pair of spacing slots on an inner wall thereof, and an outer wall of said regulating portion comprises corresponding protrusions, wherein the engagement between each of said spacing slots and said protrusions has a predetermined margin for allowing said regulation portion to a proper position so as to smooth the swing of said mobile tube pivoted to said transverse axle tube.

3. The automatic flow regulation sprinkler for gardening, as recited in claim 2, wherein said base has a first water way and second water way on opposite sides thereof; wherein two outer ends of said transverse axle tube communicates said first water way and said second water way respectively.

4. The automatic flow regulation sprinkler for gardening, as recited in claim 3, wherein said first water way is arranged inside a fixing rack fixed to said base, and said second water way is arranged inside a mobile rack fixed to said base, wherein a first water outlet and a second water outlet are formed to relative inner sides of said fixing rack and said mobile rack respectively for connecting said two ends of said transverse axle tube.

5. An automatic flow regulation sprinkler for gardening, comprising:

a base comprising a transverse axle tube, wherein said transverse axle tube has at least one water outlet; and a mobile tube comprising a front water way and an outer transverse water way linking to each other, wherein another end of said mobile tube opposite to said front water way comprises an extension portion, wherein said outer transverse water way is pivoted to said transverse axle tube, wherein said outer transverse water way comprises a regulation portion arranged around said transverse axle tube, wherein said regulation portion is a sleeve having at least one open hole, wherein when said open hole is aligned with said water outlet, the farthest range and the largest volume of the water flow is provided, wherein when said mobile tube swings by the push of said extension portion, said open hole is gradually away from said corresponding water outlet, the angle of elevation of said front water way of said mobile tube is gradually lowered, the spout ranged out of said water outlet is shortened, and water flow is gradually decreased, wherein on a top of said base having a shield, wherein a short column towards said extension portion is formed to a bottom surface of said mobile tube below said outer transverse water way, wherein said short column has a spring unit pushing against said shield.

6. The automatic flow regulation sprinkler for gardening, as recited in claim 4, wherein on a top of said base having a shield, wherein a short column towards said extension portion is formed to a bottom surface of said mobile tube below said outer transverse water way, wherein said short column has a spring unit pushing against said shield.

7. The automatic flow regulation sprinkler for gardening, as recited in claim 6, wherein two water seals are arranged between said outer sides of said transverse axle tube relative to said at least one water outlet and said outer transverse water way of said mobile tube.

8. The automatic flow regulation sprinkler for gardening, as recited in claim 7, wherein each of said water seals is located between an inner ring and an outer ring, wherein said inner ring and said outer ring are arranged to said outer transverse water way of said mobile tube.

* * * * *